US010264896B2

(12) United States Patent
Petner

(10) Patent No.: US 10,264,896 B2
(45) Date of Patent: Apr. 23, 2019

(54) HAT HOLDER AND MERCHANDISE DISPLAY UNIT

(71) Applicant: Robert Petner, Burlington, NJ (US)

(72) Inventor: Robert Petner, Burlington, NJ (US)

(73) Assignee: Frank & Davies Innovations, LLC, Flemington, NJ (US)

( * ) Notice: Subject to any disclaimer, the term of this patent is extended or adjusted under 35 U.S.C. 154(b) by 0 days.

(21) Appl. No.: 15/997,823

(22) Filed: Jun. 5, 2018

(65) Prior Publication Data

US 2018/0344058 A1 Dec. 6, 2018

Related U.S. Application Data

(60) Provisional application No. 62/515,804, filed on Jun. 6, 2017.

(51) Int. Cl.

| | |
|---|---|
| ***A47G 25/10*** | (2006.01) |
| ***A47F 7/06*** | (2006.01) |
| *F16M 13/02* | (2006.01) |

(52) U.S. Cl.

CPC ..... *A47F 7/06* (2013.01); *A47G 25/10* (2013.01); *F16M 13/02* (2013.01)

(58) Field of Classification Search

CPC ..... B65H 75/36; B65H 75/366; G09F 7/18; A47F 7/06; A47G 25/10; F16M 13/02

USPC ..... 211/30–32, 87.01, 85.11; 248/220.21, 248/223.41, 224.7, 274.1, 295.11, 297.31; 242/400.1; 40/606.01, 606.14, 611.01, 40/611.06

See application file for complete search history.

(56) References Cited

U.S. PATENT DOCUMENTS

| | | | | | |
|---|---|---|---|---|---|
| 314,591 | A | * | 3/1885 | Gibbs | A47G 25/10 211/32 |
| 331,565 | A | * | 12/1885 | Smith | A47F 5/0807 211/87.01 |
| D37,306 | S | * | 1/1905 | Gibbs | D8/356 |
| 955,260 | A | * | 4/1910 | Getman | B65H 75/366 248/89 |
| 1,601,054 | A | * | 9/1926 | Wilson | A47G 25/10 211/32 |
| D184,994 | S | * | 4/1959 | Frohman | D8/356 |
| 2,937,759 | A | * | 5/1960 | Smith | A47G 25/10 211/32 |
| D207,246 | S | * | 3/1967 | Shames | D8/356 |
| D240,486 | S | * | 7/1976 | Raffler | D8/356 |
| 4,009,532 | A | * | 3/1977 | Thomas | G09F 1/10 40/606.14 |

(Continued)

*Primary Examiner* — Jonathan Liu
*Assistant Examiner* — Devin K Barnett
(74) *Attorney, Agent, or Firm* — Stuart M. Goldstein

(57) ABSTRACT

A hat holder and merchandise display unit has a hat holder member with a curved hat brim supporting section and a vertical wall section perpendicular with and extending downwardly from the hat brim supporting section. The wall section of the hat holder member has a central slot bordered by inwardly extending sidewalls configured to accept an attachment tongue from a merchandise display member having a display section. Once the attachment tongue of the merchandise display member is positioned within the wall section slot, the merchandise display member is rigidly secured to the hat holder member to form a single hat holder and merchandise display unit.

3 Claims, 6 Drawing Sheets

(56) References Cited

U.S. PATENT DOCUMENTS 4,268,984 A * 5/1981 Taylor ..... G09F 1/12 40/606.12
4,339,045 A * 7/1982 Bodin ..... A47G 29/08 174/66
4,436,267 A * 3/1984 Eads ..... B65H 75/366 248/75
4,460,142 A * 7/1984 O'Rorke ..... F16B 2/08 248/214
4,574,507 A * 3/1986 Elliott ..... G09F 7/18 40/607.11
4,805,782 A * 2/1989 Hale ..... A47G 25/10 211/113
4,997,997 A * 3/1991 Moore ..... B65H 75/366 191/12.2 R
5,020,759 A * 6/1991 Weber ..... A47F 7/005 211/87.01
5,022,174 A * 6/1991 Goff ..... B61D 41/02 40/649
D322,746 S * 12/1991 Sassano ..... D8/356
D329,194 S * 9/1992 Gillooly ..... D8/356
5,244,102 A * 9/1993 Koenig ..... A47G 25/10 211/32
D351,552 S * 10/1994 Williams ..... D8/356
5,411,144 A * 5/1995 Deupree ..... A47F 7/06 211/30
5,419,362 A * 5/1995 Blackaby ..... A62C 33/04 137/355.16
5,480,073 A * 1/1996 LaManna ..... A47F 7/06 206/303
5,488,656 A * 1/1996 DeArkland ..... G09F 7/12 379/155
5,538,144 A * 7/1996 Reed ..... A47F 7/06 211/32
5,630,516 A * 5/1997 Helman ..... A47F 7/06 211/32
5,813,546 A * 9/1998 Wilson ..... A47F 7/06 206/461
5,921,011 A * 7/1999 Hawver ..... G09F 7/18 248/174
5,921,403 A * 7/1999 Coffaro ..... A47F 7/06 211/30
6,003,804 A * 12/1999 Vara ..... B65H 75/42 211/13.1
6,059,215 A * 5/2000 Finnis ..... B65H 75/366 242/400.1
6,079,675 A * 6/2000 Hsu ..... B65G 7/12 248/68.1
6,112,909 A * 9/2000 Moseley ..... A47F 5/0807 211/30
6,311,879 B1 * 11/2001 Rigler ..... A47F 7/06 211/30
6,338,213 B1 * 1/2002 Young ..... G09F 15/0062 40/606.14
D462,254 S * 9/2002 Wright ..... B65H 75/366 D8/356
D462,603 S * 9/2002 Wright ..... B65H 75/366 D8/356
6,547,204 B1 * 4/2003 Peck ..... G09F 7/18 248/545
6,834,813 B1 * 12/2004 Nobi ..... B65H 75/38 137/355.16
7,090,085 B1 * 8/2006 Vicendese ..... A47F 5/08 211/106.01
7,168,577 B1 * 1/2007 Moseley ..... A47F 7/06 211/32
D554,979 S * 11/2007 Hsu ..... D8/356
D561,009 S * 2/2008 Wood ..... D8/356
D571,190 S * 6/2008 Spadotto ..... B65H 75/366 D8/356
7,455,258 B2 * 11/2008 Proebstle ..... B65H 75/06 242/400.1
D600,067 S * 9/2009 Forsyth ..... D7/387
7,665,616 B1 * 2/2010 Hobbie ..... A47F 7/06 211/31
7,828,254 B2 * 11/2010 Stephens-De Alanis ..... A45D 44/00 211/30
D629,671 S * 12/2010 Ohori ..... D8/356
D639,147 S * 6/2011 Surles ..... D8/356
D646,555 S * 10/2011 Galle ..... D8/356
8,529,184 B1 * 9/2013 Hanser ..... B68C 1/002 211/85.11
D724,934 S * 3/2015 Lu ..... D8/356
D735,560 S * 8/2015 Anderson ..... D8/356
9,161,644 B2 * 10/2015 Williams ..... A47G 23/0208
D763,665 S * 8/2016 Hallare ..... D8/356
D764,259 S * 8/2016 Schoening ..... D8/356
D785,380 S * 5/2017 King ..... D6/681
9,649,547 B2 * 5/2017 White ..... A63B 71/0045
D793,209 S * 8/2017 Galpchian ..... D8/349
D798,131 S * 9/2017 Agneessens ..... D8/373
D807,733 S * 1/2018 Fretz ..... D8/356
D808,776 S * 1/2018 Ruddick ..... D8/356
D813,649 S * 3/2018 Southard ..... D8/356
2001/0032910 A1 * 10/2001 Brueske ..... B65H 75/366 248/80
2002/0166275 A1 * 11/2002 Broadwell ..... G09F 3/20 40/607.1
2003/0029893 A1 * 2/2003 Fritz ..... A47F 7/06 223/24
2003/0226861 A1 * 12/2003 Frey ..... A42B 1/002 223/14
2005/0023233 A1 * 2/2005 Yang ..... A47B 81/00 211/71.01
2007/0056918 A1 * 3/2007 Laga ..... B25H 3/04 211/41.1
2008/0163528 A1 * 7/2008 Soriano Ramos ..... A47G 1/14 40/711
2008/0164232 A1 * 7/2008 Smith ..... F16M 11/041 211/87.01
2008/0296240 A1 * 12/2008 Napier ..... A47F 7/06 211/30
2008/0301988 A1 * 12/2008 Strader ..... G09F 7/18 40/604
2009/0194495 A1 * 8/2009 Kellogg ..... B68C 1/002 211/85.11
2010/0270440 A1 * 10/2010 Goetz ..... A01G 25/165 248/75
2012/0112022 A1 * 5/2012 Cheng ..... A47G 7/044 248/205.3
2015/0154895 A1 * 6/2015 Cassidy ..... G09F 7/18 40/606.01
2018/0226000 A1 * 8/2018 Kitzerow ..... G09F 7/18

* cited by examiner

HAT HOLDER AND MERCHANDISE DISPLAY UNIT

RELATED APPLICATION

This application claims the benefit of provisional application 62/515,804 filed on Jun. 6, 2017.

BACKGROUND OF THE INVENTION

Many value conscience consumers are anxious to examine products that they may be interested in buying and, at the same time, they often want a brief description of the product, including, of course, its price. There are numerous merchandise display systems which attempt to accomplish these objectives. However, many of these tend to constitute either large bulky displays or small ones which provide little or incomplete information. Moreover, there are no merchandise display systems specifically for hanging and holding hat products, for providing a means to show information about the products, and which are lightweight, portable, and are removable for reuse.

SUMMARY OF THE INVENTION

It is thus the object of the present invention to provide a hat holder and merchandise display unit which addresses the disadvantages and limitations of existing display units, by providing a lightweight, reusable hat holder member and a merchandise display member combination which not only holds a hat to allow the consumer to clearly view it, but also has an information containing display section which is interchangeable with other display sections.

These and other objects are accomplished by the present invention, a hat holder and merchandise display unit having a hat holder member with a curved hat brim supporting section and a vertical wall section perpendicular with and extending downwardly from the hat brim supporting section. The wall section of the hat holder member has a central slot bordered by inwardly extending sidewalls configured to accept an attachment tongue from a merchandise display member having a display section. Once the attachment tongue of the merchandise display member is positioned within the wall section slot, the merchandise display member is rigidly secured to the hat holder member to form a single hat holder and merchandise display unit.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
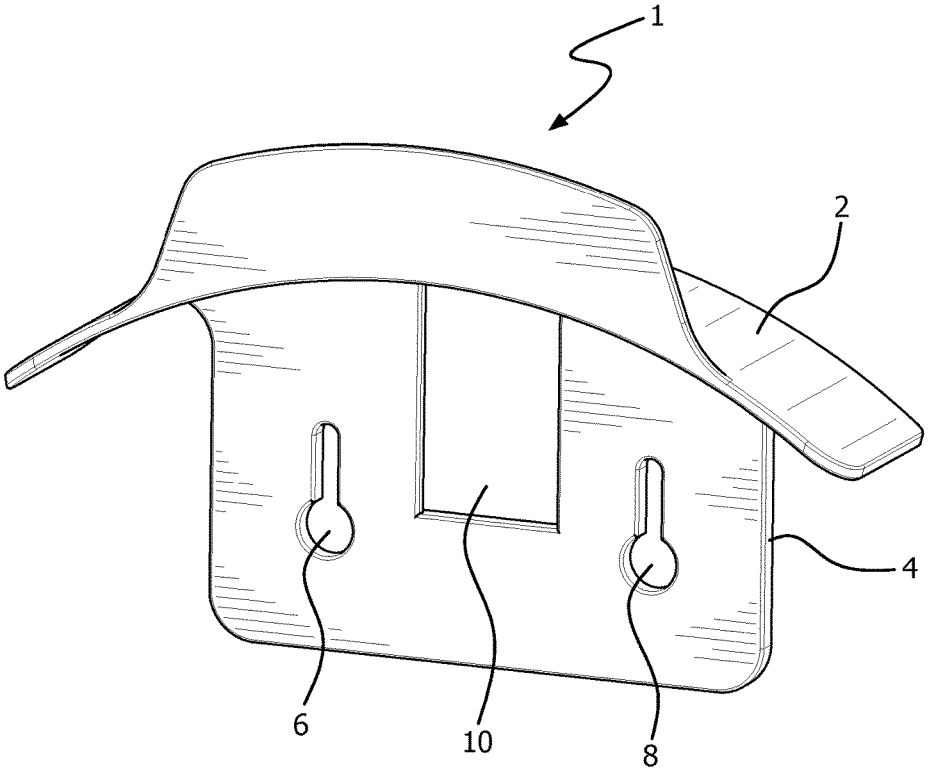
FIG. 1 is a front isometric view of the hat holder member of the present invention.
Figure 2:
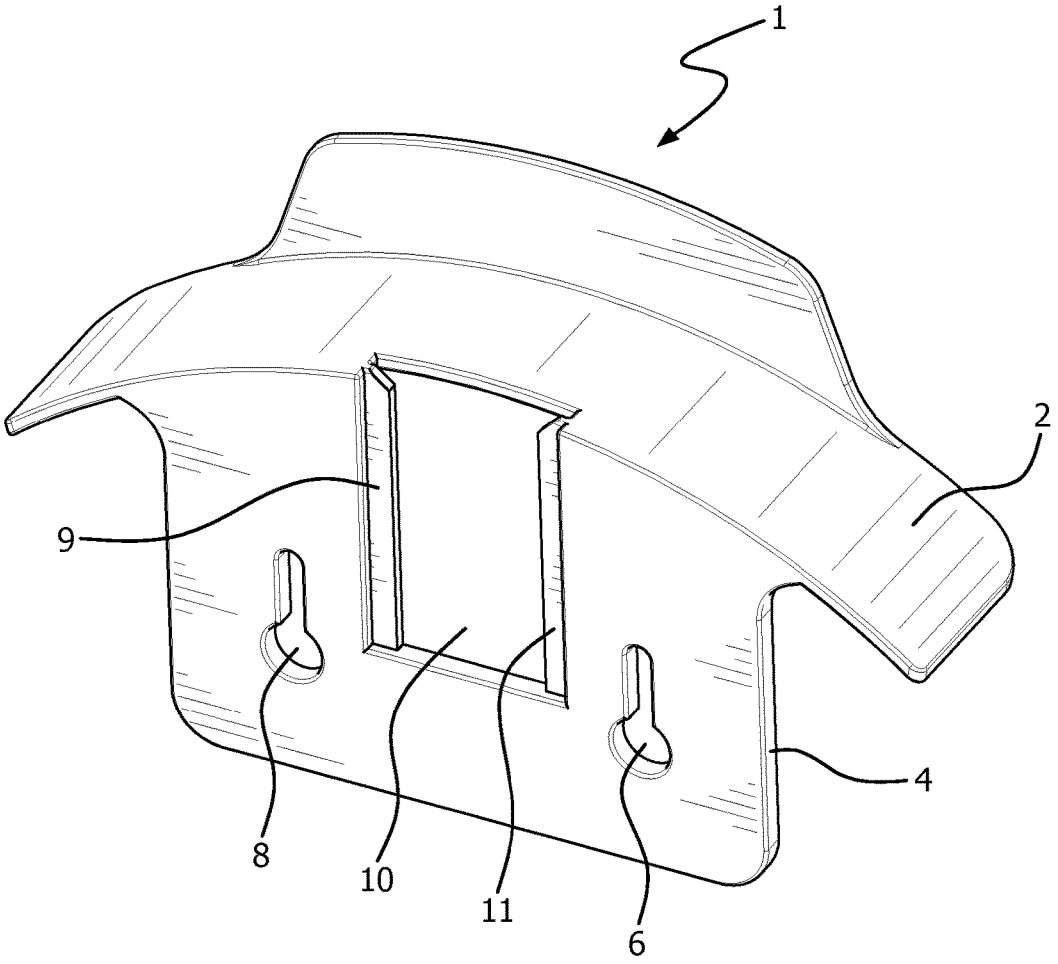
FIG. 2 is a rear isometric view of the hat holder member of the present invention.
Figure 3:
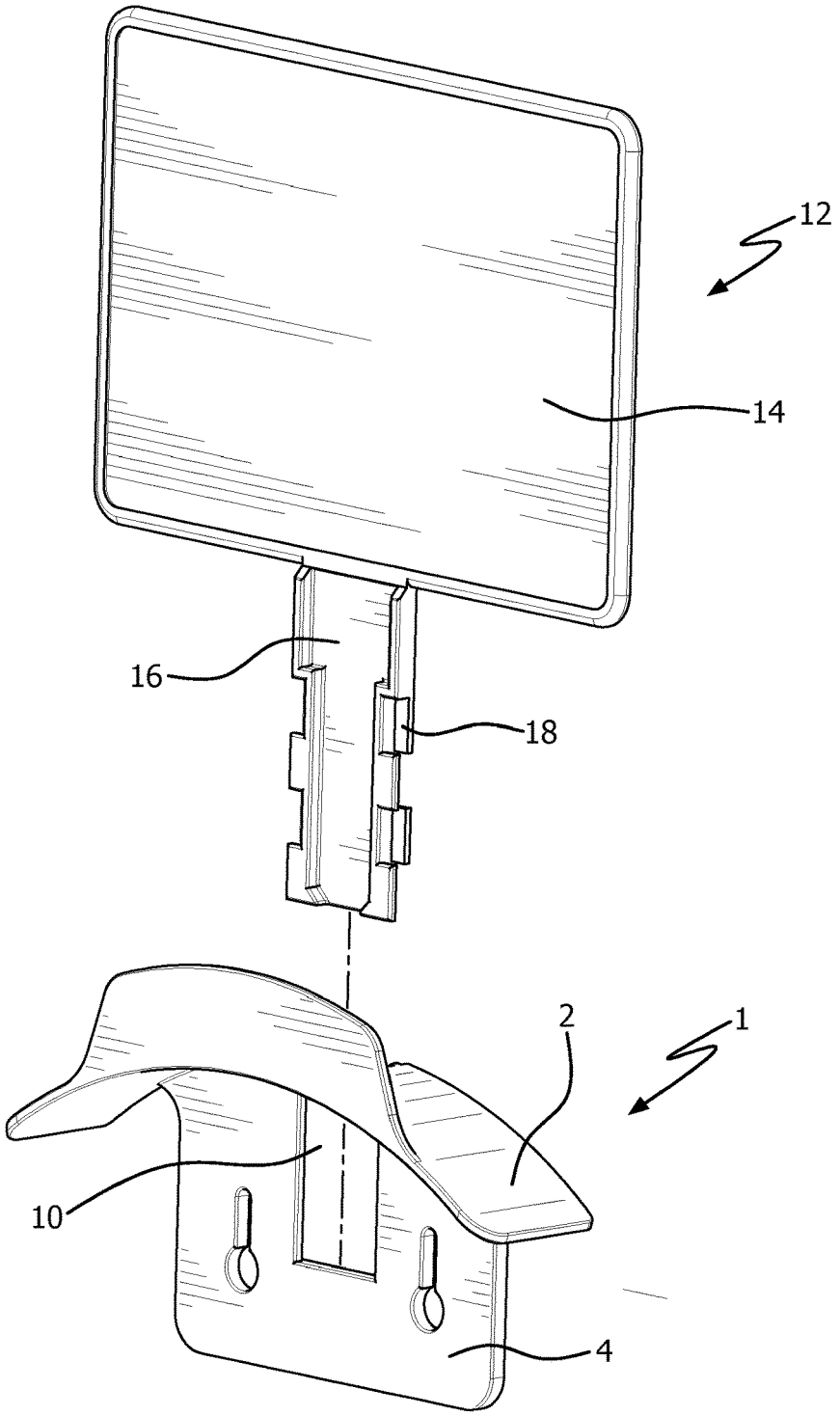
FIG. 3 illustrates the merchandise display member in position for attachment to the hat holder member.
Figure 4:
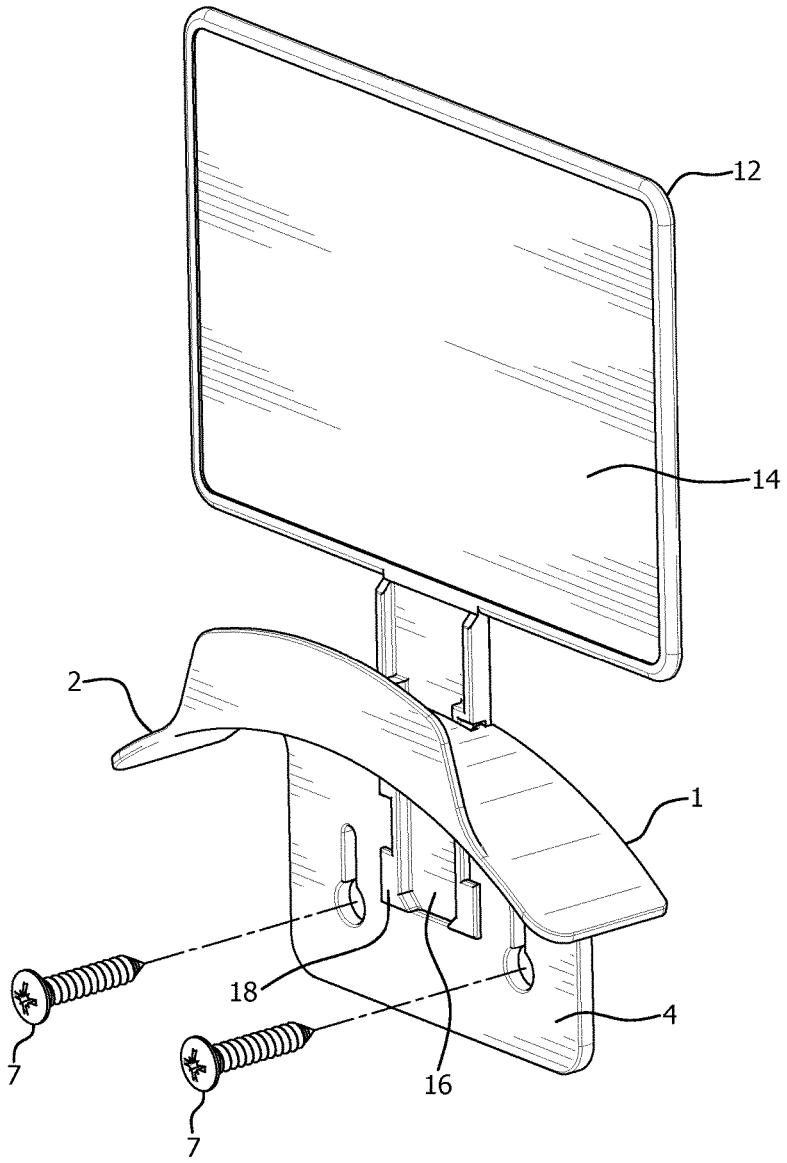
FIG. 4 is another isometric drawing of the hat holder member and merchandise display member of the present invention in their connected configuration.
Figure 5:
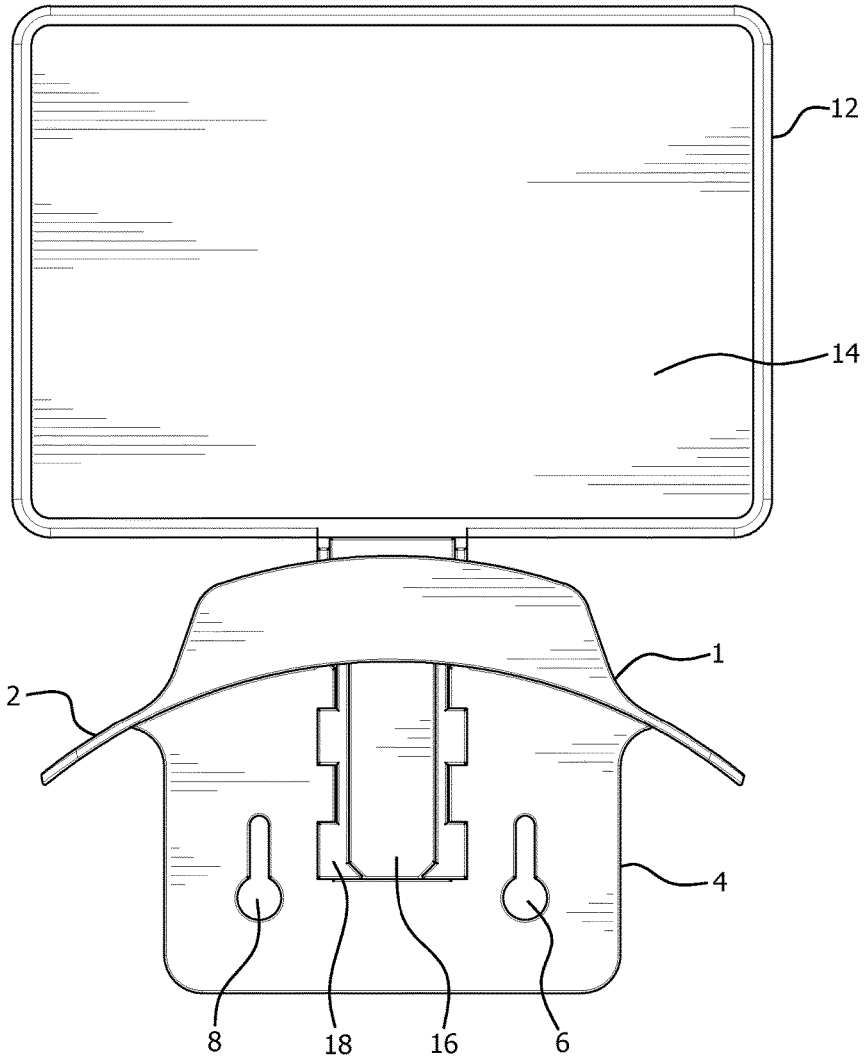
FIG. 5 is a front drawing of the hat holder member and merchandise display member of the present invention in their connected configuration.
Figure 6:
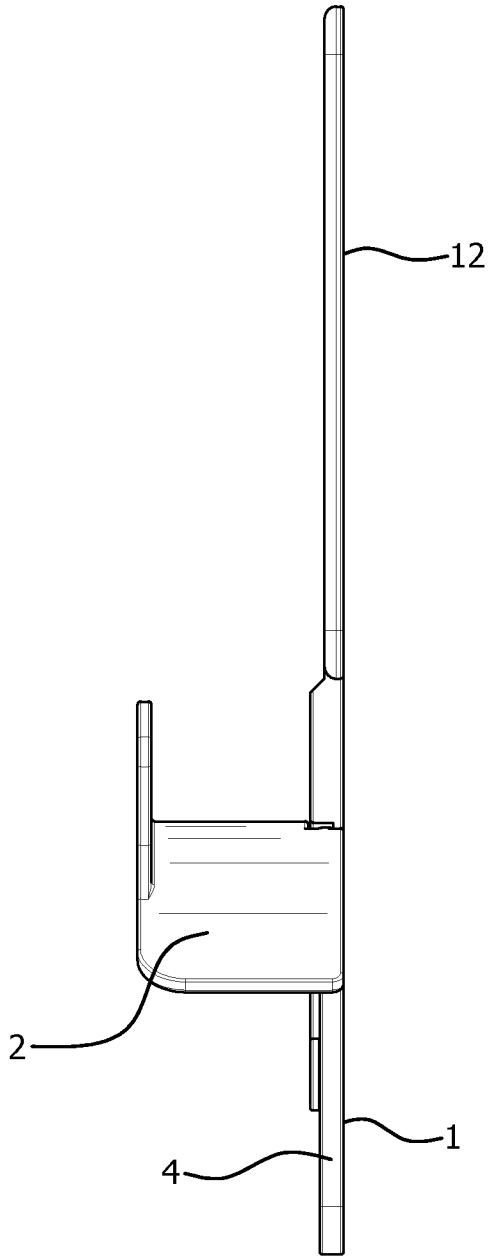
FIG. 6 is an elevation drawing of the hat holder member and merchandise display member of the present invention in their connected configuration.

Hat holder member 1 is an integral body comprising curved, hat brim support section 2 and downwardly extending, vertical wall section 4 perpendicular to the hat brim support section. Openings 6 and 8 permit the insertion of screws or like attachment devices 7 to secure hat holder member 1 to a wall, frame, or other vertical surface. Center slot 10 extends into wall section 4. Slot 10 is bordered by side walls 9 and 11 which extend inwardly into slot 10.

Merchandise display member 12 comprises display section 14 and downwardly extending attachment tongue 16. Tongue 16 has a plurality of outwardly extending tab elements 18.

Tongue 16 of display member 12 is configured to be inserted and slid into slot 10 of wall section 4. When tongue 16 is positioned within slot 10, tab elements 18 hug sidewalls 9 and 11 of slot 10, thus rigidly maintaining the display member over hat holder member 1. The result is a single, stable and secured attached hat holder and merchandise display unit which allows a hat to be easily hung and displayed from support section 2 of hat holder member 1. A description of the hat, its price, and other information can be placed on signage included on display section 14 of display member 12.

It is apparent that the invention is quite versatile, in that not only can different hats be hung for viewing on hat holder member 1, but display member 12 is also interchangeable with alternate display units. Toward this end, display member 12 can easily be slid from slot 10 of the hat holder member, and it can be removed and replaced with a different display member with different signage.

The entire hat holder and merchandise display unit can easily be removed and repositioned by removing screws 7 and then reattaching them through openings 6 and 8 after positioning the unit in another location.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A hat holder for storing hats comprising:

a hat holder member having an integral body with a transverse width, wherein the integral body comprises an arcuate hat brim support section having a front facing edge, a rear facing edge, a top surface, and a bottom surface, wherein the arcuate hat brim supporting section defines a downwardly concaved arc; wherein the hat brim support section extends continuously for at least the full transverse width of the integral body, a planar vertical wall section perpendicular with and extending downwardly from the rear facing edge of the hat brim support section, wherein the wall section is underneath the hat brim support section, wherein a central slot is formed through a central portion of the wall section, wherein the central slot defines a right edge, a left edge, a bottom edge, and an open top section, wherein a pair of sidewall protrusions inwardly extend from the right edge and the left edge of the central slot respectively; and a merchandise display sign for displaying merchandise information, the display sign comprising a display section having a first width, and a downwardly extending attachment tongue located entirely below the display section, the attachment tongue having a second width that is less than the first width of the display section, the attachment tongue being configured to be removably inserted and positioned within the central slot of the wall section, wherein when in use, the attachment tongue is positioned within the central slot, the merchandise display sign is rigidly secured to the hat holder member with the display section being located entirely above the hat holder member.

2. The hat holder as recited in claim 1, wherein the attachment tongue has a plurality of outwardly extending tab elements, wherein, when in use, the tab elements engage the sidewall protrusions of the central slot respectively when the attachment tongue is positioned within the central slot.

3. The hat holder as recited in claim 1, wherein the wall section comprises openings, wherein each opening is configured to receive a fastener to secure the hat holder to a vertical surface.

* * * * *